US007422127B2

(12) United States Patent
Christoffersen et al.

(10) Patent No.: US 7,422,127 B2
(45) Date of Patent: Sep. 9, 2008

(54) LID DISPENSER

(75) Inventors: Steve Christoffersen, San Antonio, TX (US); Thomas R. Hecht, Winters, CA (US); Scott Thompson, San Antonio, TX (US); Michael E. Simi, Danville, CA (US)

(73) Assignee: Redi-Lid LP, San Antonio, TX (US)

( * ) Notice: Subject to any disclaimer, the term of this patent is extended or adjusted under 35 U.S.C. 154(b) by 185 days.

(21) Appl. No.: 11/249,732

(22) Filed: Oct. 12, 2005

(65) Prior Publication Data

US 2006/0157493 A1 Jul. 20, 2006

Related U.S. Application Data

(60) Provisional application No. 60/619,811, filed on Oct. 18, 2004.

(51) Int. Cl.
*B65H 3/00* (2006.01)

(52) U.S. Cl. ..... 221/40; 221/191; 221/195; 221/270; 221/276

(58) Field of Classification Search ..... 221/40, 221/191, 195, 270, 276
See application file for complete search history.

(56) References Cited

U.S. PATENT DOCUMENTS

| | | | | |
|---|---|---|---|---|
| 1,012,444 | A | | 12/1911 | Robbins |
| 1,023,097 | A | | 4/1912 | Robbins |
| 1,170,705 | A | | 2/1916 | Swift |
| 1,180,887 | A | | 6/1916 | Cooley |
| 1,593,717 | A | | 7/1926 | Frick |
| 2,361,364 | A | | 10/1944 | Bell |
| 2,665,832 | A | | 1/1954 | Bagby |
| 2,704,629 | A | | 3/1955 | Andre et al. |
| 2,712,893 | A | | 7/1955 | Charland |
| 2,730,268 | A | | 1/1956 | Moesch |
| 2,851,192 | A | * | 9/1958 | Mayo et al. ..... 221/273 |
| 3,071,292 | A | | 1/1963 | Atwood et al. |
| 4,184,523 | A | | 1/1980 | Carrigan et al. |
| 4,295,580 | A | | 10/1981 | Amberg |
| 4,594,838 | A | | 6/1986 | Ficken et al. |
| 4,835,943 | A | | 6/1989 | Mueller |

(Continued)

*Primary Examiner*—Gene O. Crawford
*Assistant Examiner*—Timothy R Waggoner
(74) *Attorney, Agent, or Firm*—Townsend and Townsend and Crew LLP

(57) ABSTRACT

A dispensing apparatus for dispensing a lid from a stack of lids each having a lid periphery includes a load platform having a main floor on which to place a stack of lids, the main floor sloping downward from an apex in a rearward direction, the load platform having a forward slope inclined downward from the apex in a forward direction. A parallelogram mechanism is mounted to move in a linear direction forward to a dispense position and rearward to a home position. A hinge is coupled to the parallelogram mechanism and has a handle with a distal end oriented upward and forward to contact an inner surface of a lid periphery of a bottommost lid of the stack of lids when the parallelogram mechanism moves forward from the home position toward the dispense position. After the distal end of the handle of the hinge contacts the inner surface of the lid periphery of the bottommost lid, the parallelogram mechanism deforms to de-elevate the hinge and move the distal end of the handle of the hinge downward causing the bottommost lid to deformably move downward to the forward slope of the load platform to separate from the stack of lids for dispensing.

15 Claims, 10 Drawing Sheets

U.S. PATENT DOCUMENTS

| | | | |
|---|---|---|---|
| 4,949,526 | A | 8/1990 | Brogna et al. |
| 4,989,753 | A | 2/1991 | Brogna et al. |
| 5,000,345 | A | 3/1991 | Brogna et al. |
| 5,038,969 | A | 8/1991 | Berger |
| 5,692,359 | A | 12/1997 | Casler, Jr. et al. |
| 5,819,982 | A | 10/1998 | Brown |
| 5,960,989 | A | 10/1999 | Gunderson |
| 6,471,092 | B1 | 10/2002 | Thompson |
| 6,474,503 | B2 | 11/2002 | Davis |
| 2001/0038017 | A1 | 11/2001 | Davis |
| 2005/0092767 | A1 | 5/2005 | Schroeder |
| 2005/0194397 | A1 | 9/2005 | Hecht |

* cited by examiner

LID DISPENSER

CROSS-REFERENCES TO RELATED APPLICATIONS

This application claims the benefit of U.S. Provisional Patent Application No. 60/619,811, filed Oct. 18, 2004, the entire disclosure of which is incorporated herein by reference.

BACKGROUND OF THE INVENTION

This invention relates to article dispensing apparatus and, more particularly, to a lid dispenser for dispensing a lid from a stack of plastic cup lids.

In restaurants or other food or beverage venues, lids are made available for the covering of items generally served or supplied in cups or similar containers. A major goal of a retail operation is to encourage and enable the customers to frequently patronize the establishment. Customer satisfaction is paramount to repeat business. A key source of customer dissatisfaction is related the lack of cleanliness and/or perceived lack of cleanliness. The cleanliness cannot be guaranteed for lids that are provided atop a stack of lids, made available in a conventional way (e.g., in an open bin-type dispenser), and presented for use. In attempting to locate a suitably clean lid, the user will often separate multiple lids from the stack of lids until a suitably clean lid is found. The removed lids are then placed away from the dispenser (allowing them to become even more unsanitary), replaced within the stack (introducing further contamination), or discarded (resulting in higher refill expense).

Article dispensing apparatus are known in the art. For example, U.S. Pat. No. 6,471,092 discloses a dispenser for dispensing an endmost lid from a stack of vertically orientated nestable lids. The dispenser may include a dispensing mechanism, which in turn further includes a track member, a tube, three supports, three arms, and three pins. The track member can have a ringed configuration and form a groove on a face. Desirably, the tube is inserted in and coupled to the track member wherein the tube forms a cylindrical chamber for receiving a stack of nestable lids and forms three triangular holes and three slots. Each support may include a body formed integrally with a post for being received within the groove and a ledge and each arm may include a body formed integrally with a post for being received within the groove and further may form a slot. Each pin can have an end received within the slot of a respective arm, whereby rotating the track member may extend and retract the ledges of supports and the pins through respective slots and triangular holes in the tube. The isolating members are rather complex. The apparatus has many parts, and is operated by a motor. The size variation range of the articles being dispensed is small.

BRIEF SUMMARY OF THE INVENTION

The present invention relates to a more robust article dispensing apparatus for dispensing articles in a clean and protective environment. More specifically, the apparatus accepts, separates, and dispenses articles from a nested stack of articles such as beverage cup lids one at a time. Advantageously, the apparatus can accept and dispense articles having different sizes. The apparatus can be manually operated without the use of electrical, pneumatic, or hydraulic power, but may employ the use of such power as well as automation and controls.

An aspect of the present invention is directed to a dispensing apparatus for dispensing a lid from a stack of lids each having a lid periphery. The apparatus comprises a load platform having a main floor on which to place a stack of lids, the main floor sloping downward from an apex in a rearward direction, the load platform having a forward slope inclined downward from the apex in a forward direction. A parallelogram mechanism has a lower parallelogram portion, an upper parallelogram portion, and a pair of parallelogram wires connected between the lower parallelogram portion and the upper parallelogram portion to form a parallelogram and permit the lower parallelogram portion to move with respect to the upper parallelogram portion to change a shape of the parallelogram formed thereby. The parallelogram mechanism is mounted to move in a linear direction forward to a dispense position and rearward to a home position. A hinge is coupled to the upper parallelogram portion and has a rotatable handle with a distal end oriented upward and forward to contact an inner surface of a lid periphery of a bottommost lid of the stack of lids when the parallelogram mechanism moves forward from the home position toward the dispense position. After the distal end of the handle of the hinge contacts the inner surface of the lid periphery of the bottommost lid, the upper parallelogram portion stops moving forward and the lower parallelogram portion continues moving forward to de-elevate the upper parallelogram portion and move the distal end of the handle of the hinge downward causing the bottommost lid to deformably move downward to the forward slope of the load platform to separate from the stack of lids for dispensing.

In some embodiments, the lower parallelogram portion of the parallelogram mechanism is slidably coupled with a plurality of carriage rods to move in the linear direction forward to the dispense position and rearward to the home position. A return spring is coupled between the upper parallelogram portion and the lower parallelogram portion of the parallelogram mechanism to bias the parallelogram mechanism toward a rest configuration in which the upper parallelogram portion is not de-elevated. A reverse travel stop in the home position prevents the parallelogram mechanism from moving past the home position rearward. The rotatable handle of the hinge is spring loaded in rotation to bias the distal end of the handle of the hinge in the upward direction to move the lid periphery of the bottommost lid forward. The upper parallelogram portion includes a travel stop for the handle of the hinge to stop rotation of the handle of the hinge at a location to limit rearward movement of the distal end of the handle of the hinge. The distal end of the handle of the hinge includes a plurality of contact protrusions. The distal end of the handle of the hinge has a convex curved edge and the plurality of contact protrusions are formed along at least a portion of the curved edge. The distal end of the handle of the hinge is enlarged to have a wide distal end to provide more contact between the contact protrusions and the inner surface of the lid periphery of the bottommost lid to move the bottommost lid forward to dispense the bottommost lid.

In specific embodiments, a lid blocker or lid nacelle is disposed forward of the load platform to block forward movement of the stack of lids when the parallelogram mechanism drives the handle of the hinge to move the bottommost lid forward for dispensing. The lid blocker has an adjustable gate disposed rearward to face the stack of lids, the adjustable gate being adjustable vertical in height to accommodate different heights of lids to be dispensed. The lid blocker includes a screw coupled to the adjustable gate to adjust the vertical position of the adjustable gate. The adjustable gate includes a pair of vertical ribs to contact the stack of lids to block forward movement of the stack of lids when the parallelogram mechanism drives the handle of the hinge to move the bottommost lid forward for dispensing, and to provide a space between the vertical ribs for the lids to deform. The adjustable gate includes a rubber surface disposed between the pair of vertical ribs for contacting the lid peripheries of the lids moving forward. A keeper is disposed forward of and rotatably coupled to the lid blocker, the keeper being biased in the rearward direction to impede forward momentum of the lid being dispensed after being separated from the stack of lids. A lid insert selected to be disposed on the load platform to register a forward tangent point of the bottommost lid to be dispensed in a same location regardless of a size of the bottommost lid.

Another aspect of the invention relates to a dispensing apparatus for dispensing a lid from a stack of lids each having a lid periphery. The apparatus comprises a load platform having a main floor on which to place a stack of lids, the main floor sloping downward from an apex in a rearward direction, the load platform having a forward slope inclined downward from the apex in a forward direction; and means for moving a handle in a linear direction forward to a dispense position and rearward to a home position, for moving a distal end of the handle forward to contact an inner surface of a lid periphery of a bottommost lid of the stack of lids toward the dispense position, and for de-elevating the handle in the dispense position to cause the bottommost lid to deformably move downward to the forward slope of the load platform to separate from the stack of lids for dispensing.

DETAILED DESCRIPTION OF THE INVENTION

Embodiments of the present invention are directed to a manual lid dispenser that accepts a stack of lids stacked vertically on a load platform that is angled slightly rearward. The purpose for the rearward angle will be discussed later. Beneath the load platform is a "parallelogram" mechanism that acts to strip the bottom lid out from under the stack and deliver it to the customer. The parallelogram mechanism is mounted to two parallel rails or rods that constrain motion of the parallelogram mechanism to one degree of freedom. That is, the parallelogram mechanism can move fore and aft only. The parallelogram mechanism and the shape of the load platform provide the functional basis of the device.

Figure 1:
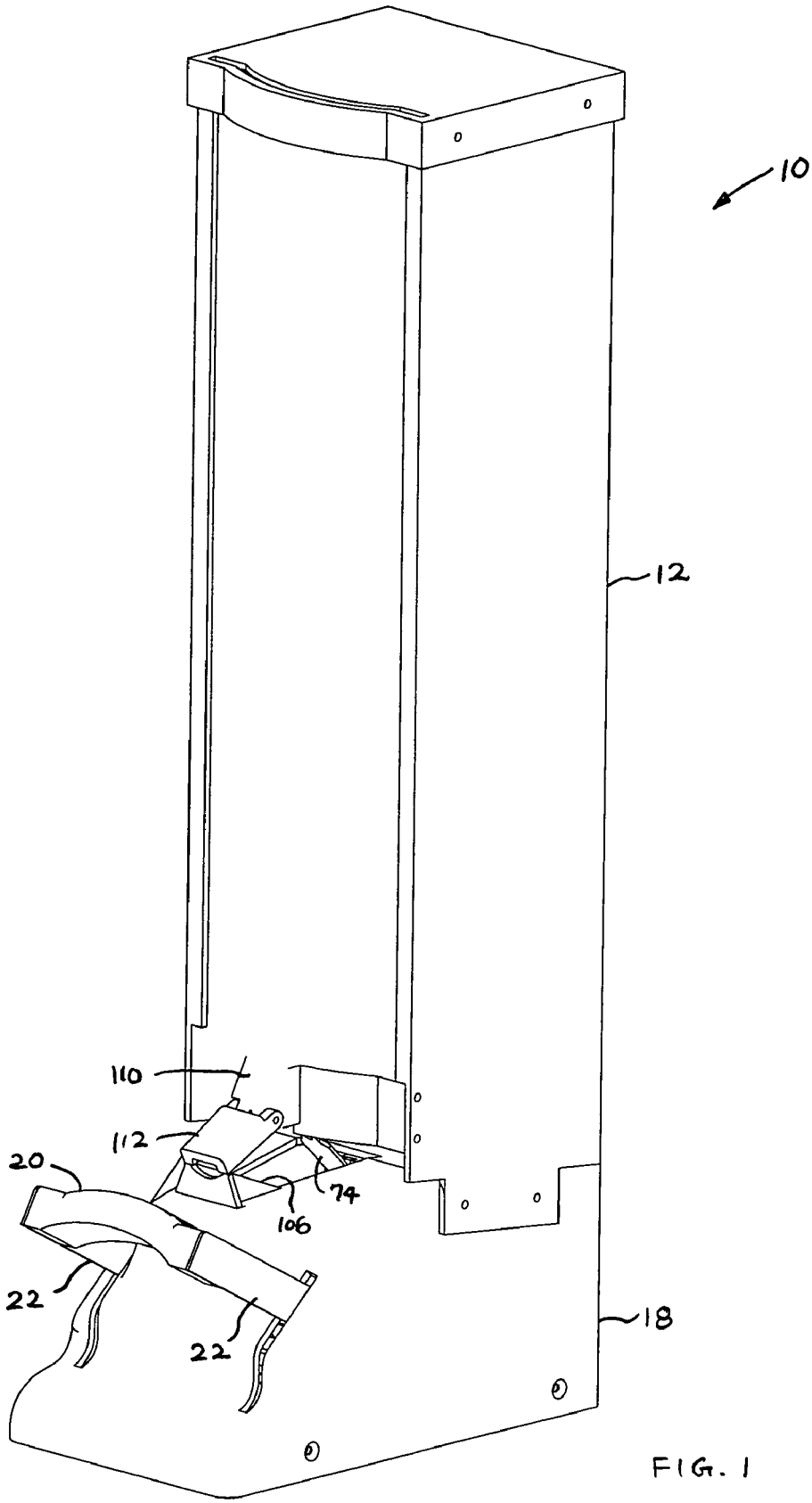
FIG. 1 is a perspective view of a lid dispenser according to an embodiment of the present invention.
Figure 2:
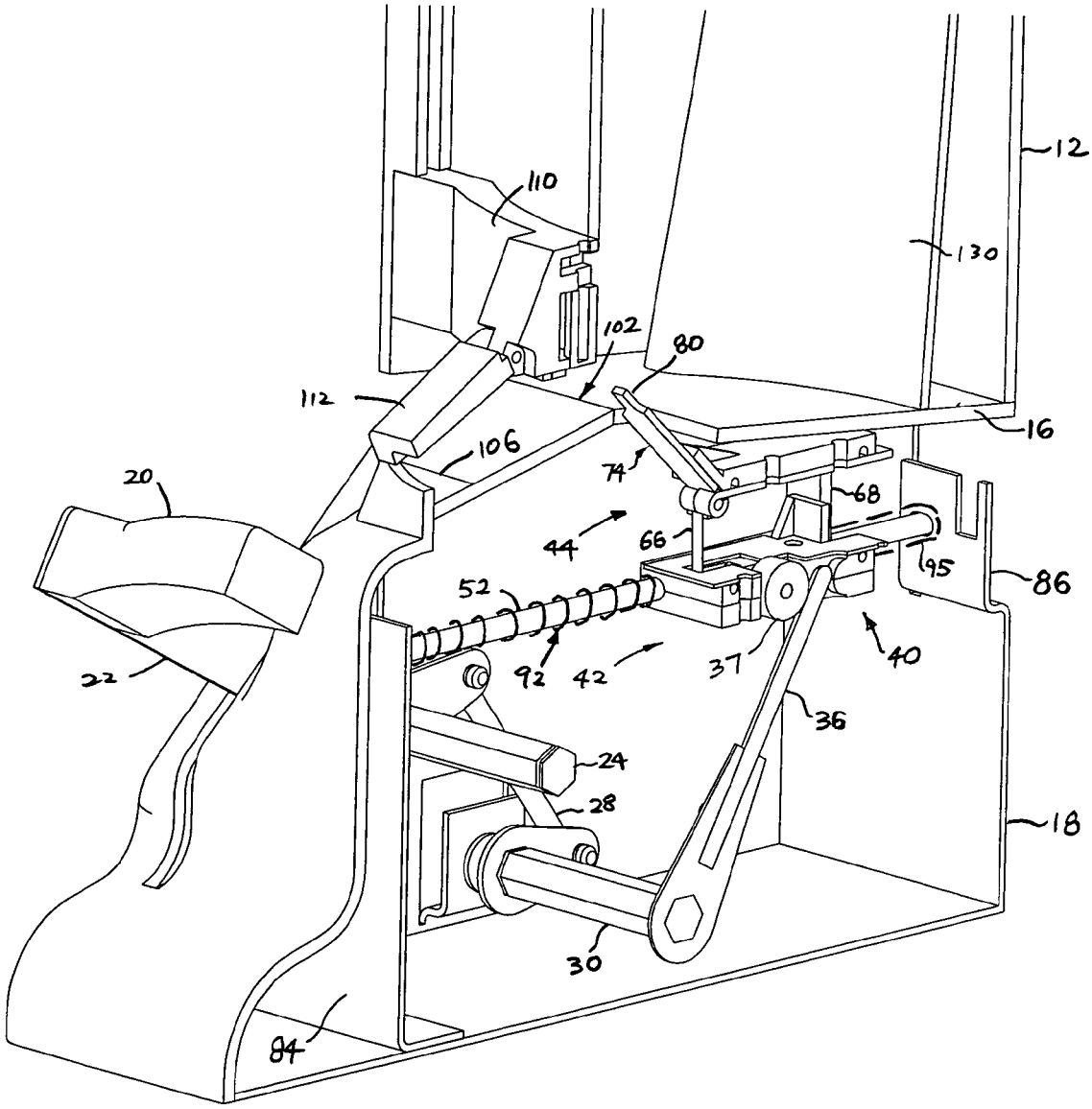
FIG. 2 is a perspective view showing the interior mechanisms of the lid dispenser of FIG. 1.
Figure 3:
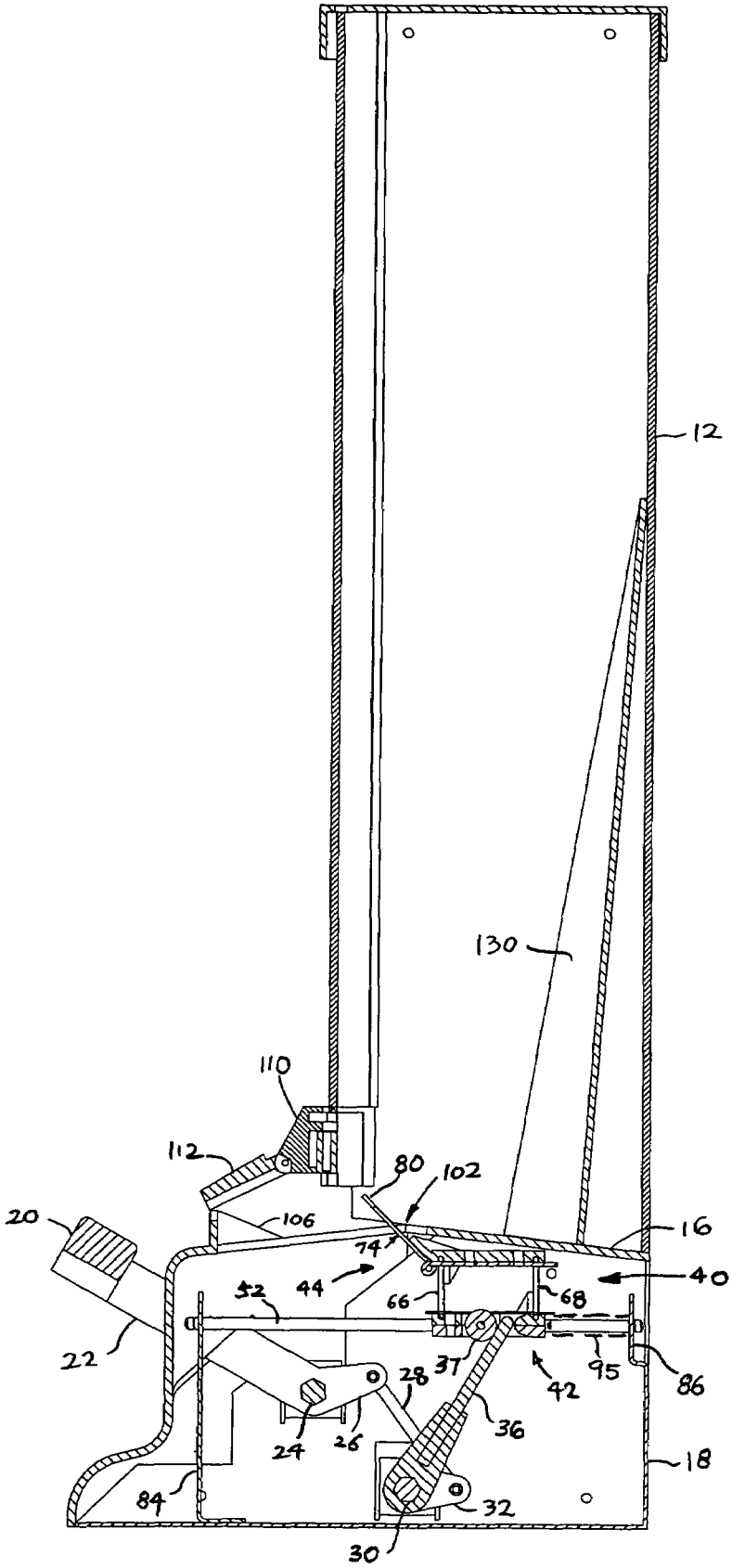
FIG. 3 is a cross-sectional view showing the interior mechanisms of the lid dispenser of FIG. 1.

As shown in FIGS. 1-3, the lid dispenser 10 includes a lid enclosure or housing 12 disposed above a load platform 16, which is positioned above a base housing 18. The lid stack of cup lids are provided in the lid housing 12 above the load platform 16. As depicted in this embodiment, there is a mechanical linkage that begins with a hand operated press bar 20 connected to the end of a pair of levers 22 which are both connected to a common, first pivot shaft (primary pivot shaft) 24 on each lever. Disposed opposite from the press bar 20 is an offset crank 26 that allows for a linkage connection 28 to a second pivot shaft (secondary pivot shaft) 30. The second shaft 30 also has an offset crank 32 that allows for the linkage connection with the primary shaft 24. Coupled to the second shaft 30 is a wipe rod 36 that interacts with the parallelogram mechanism or assembly.

In general, as a customer depresses the press bar 20, the levers 22 rotate downward through a defined arc of motion. This causes the offset crank 26 of the first shaft 24 to pull the linkage 28, thus causing the second shaft 30 to rotate. As the second shaft 30 rotates, the wipe rod 36 causes the parallelogram assembly to move forward (toward the press bar 20) and dispense a lid.

The linkage mechanism as described actuates the parallelogram assembly in a mechanical fashion, but it is also contemplated that an electromechanical mechanism may be used instead to drive the parallelogram mechanism. For instance, instead of the press bar, a button can be pushed to activate an electrical motor or drive to move the parallelogram mechanism. One example of an electromechanical mechanism is a reversible gear motor that causes the parallelogram assembly to move fore and aft.

Figure 5:
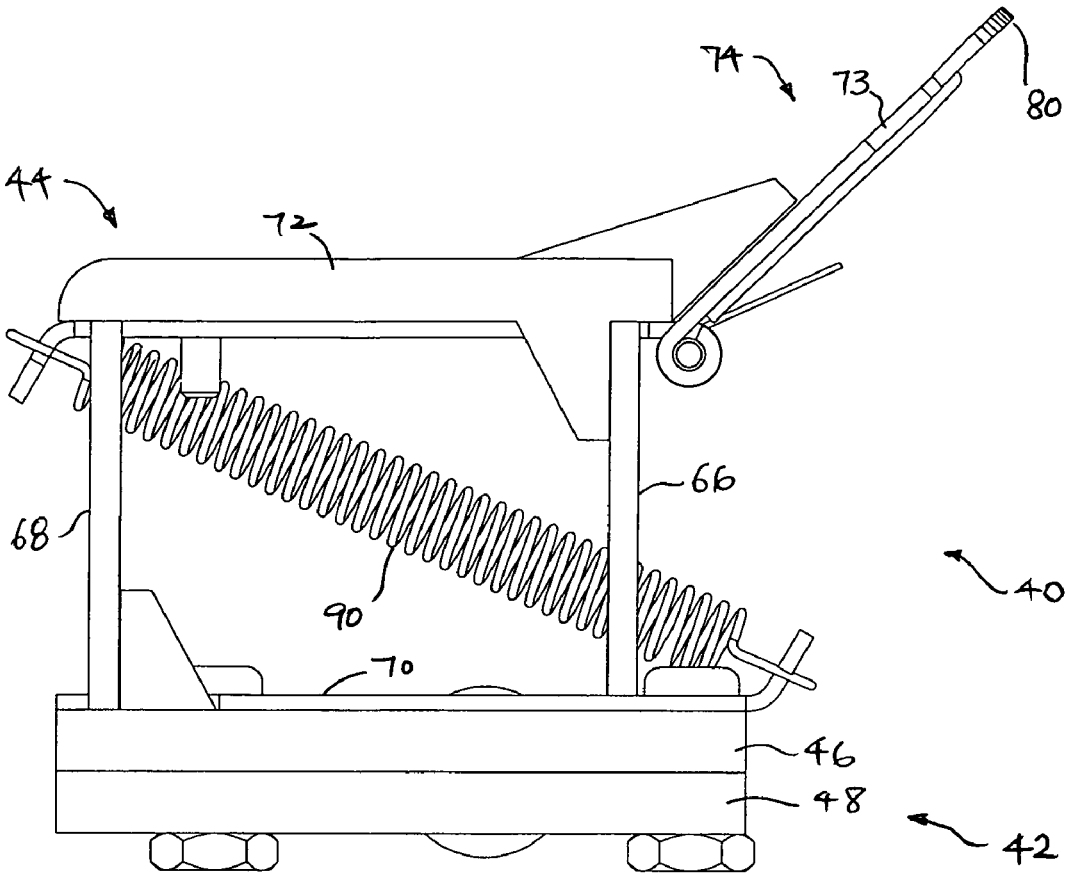
FIG. 5 is an elevational view of the parallelogram mechanism of FIG. 4.
Figure 4:
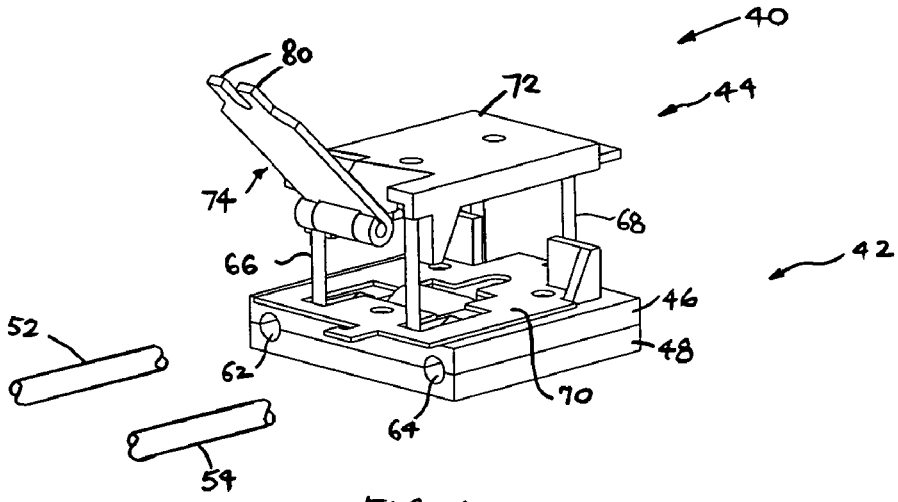
FIG. 4 is perspective view of a parallelogram mechanism in the lid dispenser of FIG. 1.
Figure 6:
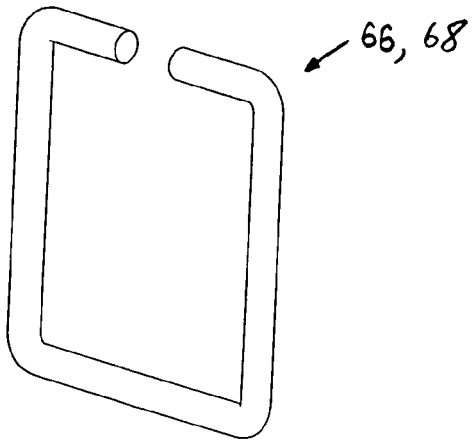
FIG. 6 is a perspective view of a parallelogram wire in the parallelogram mechanism of FIG. 4.
Figure 7:
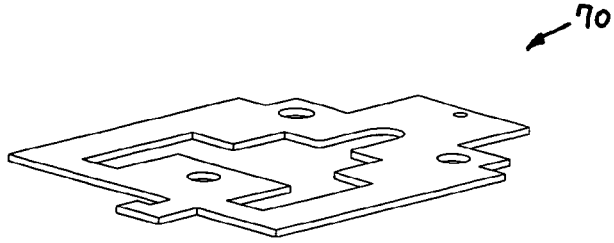
FIG. 7 is a perspective view of a retaining plate in the parallelogram mechanism of FIG. 4.

The parallelogram mechanism 40 is shown in FIGS. 4 and 5, and includes a lower parallelogram structure 42 and an upper parallelogram structure 44. The lower structure 42 has two structural plates 46, 48 that are roughly mirror images of each other that clamp onto a pair of carriage rods 52, 54. The carriage rods 52, 54 are mounted in the base housing 18 as seen in FIGS. 2 and 3, and will be described below. When clamped together, the two plates 46, 48 act to form two cylindrical through bores 62, 64 that accept the carriage rods 52, 54. The top surface of the upper plate 46 contains recesses that accept two structural wires 66, 68, which are generally identical in shape and roughly bent into a rectangular shape (see FIG. 6). A retaining plate 70 attaches to the top of the upper plate 46 and is used to retain the two rectangular parallelogram wires 66, 68. The retaining plate 70 is more clearly shown in FIG. 7, and is typically made of metal.

Figure 8:
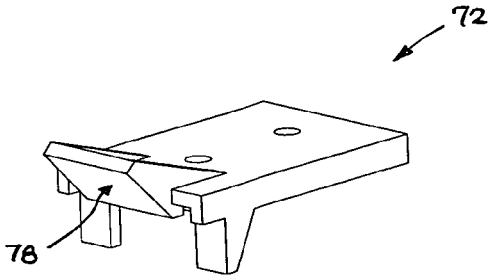
FIG. 8 is a perspective view of a structural plate of an upper parallelogram structure in the parallelogram mechanism of FIG. 4.
Figure 9:
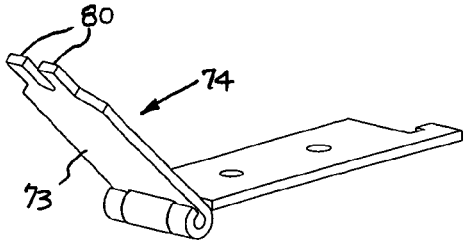
FIG. 9 is a perspective view of a spring loaded hinge of the upper parallelogram structure in the parallelogram mechanism of FIG. 4.

The upper parallelogram structure 44 of the parallelogram assembly of FIGS. 4 and 5 includes a structural plate 72 and a hinge 74 having a spring loaded handle 73 with a distal free end. The structural plate 72 also contains complementary recesses to accept the opposing sides of the parallelogram wires 66, 68. The assembly of the structural plate 72 and the spring loaded hinge 74 act to retain the parallelogram wires 66, 68. As best seen in FIG. 8, the structural plate 72 has a protruding feature 78, oriented about 45 degrees to the face of the plate 72, that acts as a travel stop for the handle 73 of the spring loaded hinge 74. As best seen in FIG. 9, the free end of the handle 73 of the spring loaded hinge 74 is cut to a specific shape resembling two "fingers" 80 that interact with the underside of a lid skirt or lid periphery to effect the action of dispensing a lid, as described below. The spring in the spring loaded hinge 74 biases the free end with the two fingers 80 upward to contact the protruding feature or travel stop 78 (see torsion spring in FIG. 19).

The parallelogram mechanism 40 as mounted in the base housing 18 of the lid dispenser 10 is illustrated in FIGS. 2 and 3, and is constrained to movement in one degree of freedom by virtue of the fact that it is mounted on two generally parallel carriage rods 52, 54 that are assembled into the base housing 18 of the lid dispenser 10. For illustrative purposes, only half of the parallelogram mechanism 40 and only one carriage rod 52 is shown in FIGS. 2 and 3. The carriage rods 52, 54 are supported between a forward carriage rod support 84 and a rearward carriage rod support 86 of the base housing 18. The parallelogram mechanism 40 can move relative to the carriage rods 52, 54 forward toward the forward support 84 and rearward toward the rearward support 86. With the parallelogram assembly 40 mounted to the carriage rods 52, 54, there is a return spring 90 that is mounted diagonally between the lower parallelogram structure 42 and upper parallelogram structure 44 (see FIG. 5). The purpose for the return spring 90 is to return the parallelogram assembly 40 to a repeatable rest configuration (or upright configuration) in which the upper parallelogram portion 44 is not de-elevated, after each dispense cycle. The return spring 90 on the parallelogram assembly (FIG. 5) that is connected between the upper and lower parallelogram portions 44, 42 keeps the parallelogram assembly 40 in an upright position. As described below in connection with FIGS. 12 and 13, the parallelogram assembly 40 changes shape by de-elevating the upper parallelogram portion 44 with respect to the lower parallelogram portion 42 during a dispense cycle to dispense the bottommost lid. As the parallelogram assembly 40 moves back to the home position after the dispense cycle, the return spring 90 returns the parallelogram assembly to the rest or upright configuration. Among others, operation effectiveness of the lid dispenser mechanism is influenced by proper selection of the return spring 90.

FIG. 2 shows a carriage return spring 92 is wrapped around the carriage rod 52. Another carriage return spring will also be wrapped around the carriage rod 54. The springs 92 on the carriage rods 52, 54 are compressed during a dispense cycle when the parallelogram assembly 40 moves from the home position to the dispense position. Then when the press bar 20 is released, the compressed springs 92 relax and cause the parallelogram assembly 40 to move back to the home position. It is noted that the carriage return spring 92 may be configured differently in other embodiments. A carriage return spring would be necessary for manual actuation and may be necessary in a configuration utilizing electromechanical actuation.

Given the spatial relationship between where the lid stack is located on the load platform 16 and where the bottommost lid is pulled forward to its dispense point, the parallelogram assembly 40, constrained by the carriage rods 52, 54, travels through a given and defined distance of motion during each dispense cycle. Therefore, the wipe rod 36 must travel through a prescribed and repeatable arc of motion for each dispense cycle. Also, it is desirable for the press bar 20 to travel through a prescribed arc of motion for each dispense, so that there is a calculable relationship between the length of the levers 22, the length and orientation of the crank offsets 26, 32 and the length of the linkage 28 which all act in concert to propel the parallelogram mechanism 40 through the desired length of travel. In the specific embodiment shown, the press bar 20 and levers 22 travel through an arc of about 45 degrees and the wipe rod 36 travels through an arc of about 53 degrees to effect the dispense of a single lid. Also, the wipe rod 36 acts against an axle-mounted wheel 37 that is preferably made of high lubricity, low wear plastic (e.g., acetal) for low wear and maintenance free life. Of course, other configurations having different dimensions and angles can be employed.

Figure 10:
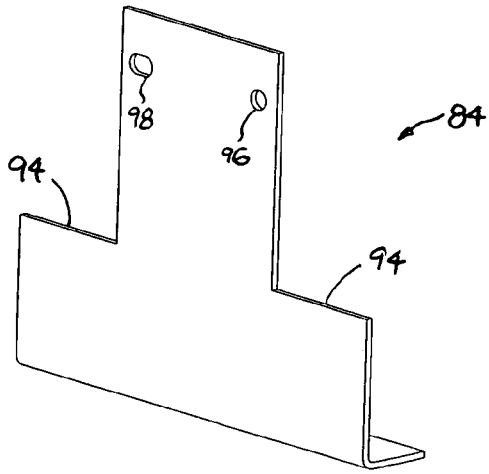
FIG. 10 is a perspective view of a forward carrier rod support in the lid dispenser of FIG. 1.

As best seen in FIG. 10, the forward carriage rod support 84 also incorporates a shoulder feature 94 that acts as a travel stop for the press bar 20 and lever 22 assembly as the press bar 20 is being depressed. When the wipe rod 36 moves the parallelogram assembly 40 from the dispense position back to the home position, reverse travel stops 95, installed as cylinders of predefined length and assembled onto the carriage rods 52, 54 rearward of the parallelogram assembly 40, stop the parallelogram assembly 40 in the home position (see FIG. 2). At the same time, the parallelogram assembly return spring 90 returns the assembly 40 to its rest configuration (see FIG. 5). Preferably, while one mount hole 96 is round in shape and corresponds to the outside diameter of one carriage rod 54, the other mount hole 98 is oblong in shape for the reason of alignment. Similar mount holes are provided in the rearward carriage rod support 86. It would not be desirable for the parallelogram assembly 40 to bind on the carriage rods 52, 54 during operation.

Figure 11:
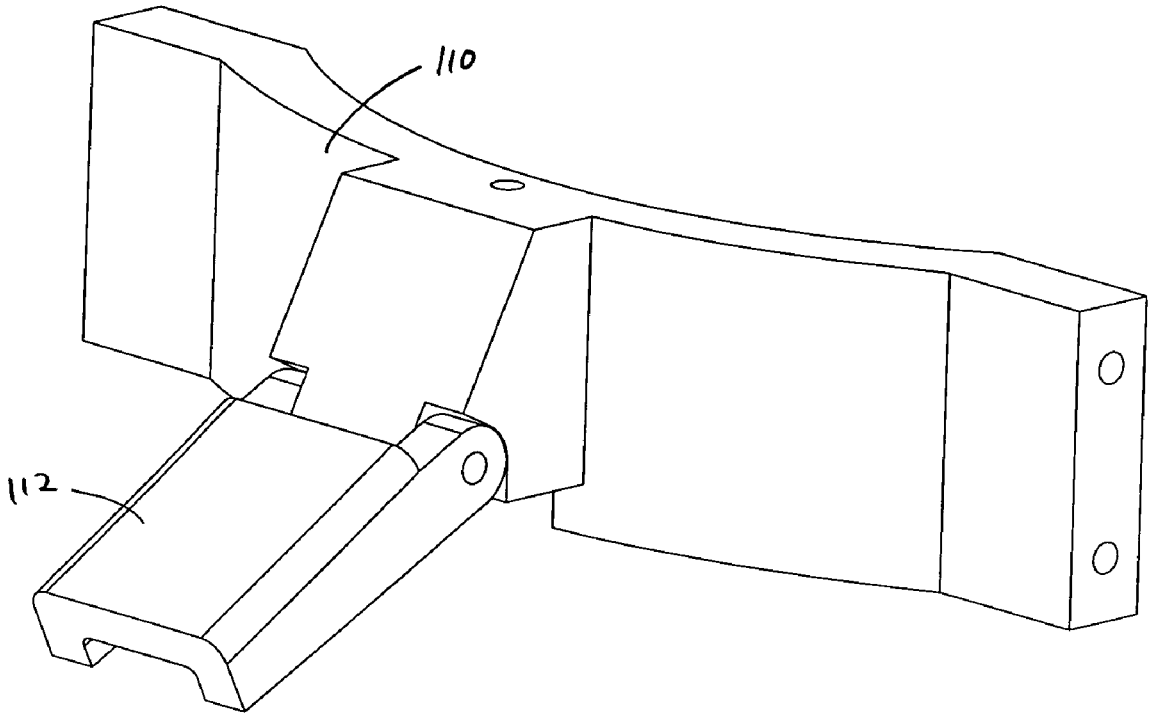
FIG. 11 is a perspective view of a lid nacelle and a spring loaded keeper in the lid dispenser of FIG. 1.

The shape of the load platform 16 is arranged to provide a main load floor that is sloped down and toward the rear. Near the apex 102 of the load floor is where the free end of the handle 73 of the spring loaded hinge 74 rests when the parallelogram mechanism 40 is in the home position. From the apex 102 of the load platform 16, the floor slopes downward as it comes forward. At the forward end of the load platform 16 there are two ramps 106 situated symmetrically about the spring loaded parallelogram hinge 74 when it is in its farthest forward position. These ramps 106 act to retain a dispensed lid when it is brought forward as the parallelogram assembly 40 retracts. Just above the load platform 16 just forward of the spring loaded hinge 74 when the parallelogram mechanism 40 is at the home position, there is a lid nacelle or lid blocker 110 that acts to define the lid enclosure 12. The lid nacelle 110 also acts as a barrier for the stack of lids to hold them in place during a dispense cycle. The lid nacelle 110 is more clearly shown in FIG. 11. A spring loaded keeper 112 is connected to the lid nacelle 110, and its function is described below.

Figure 12:
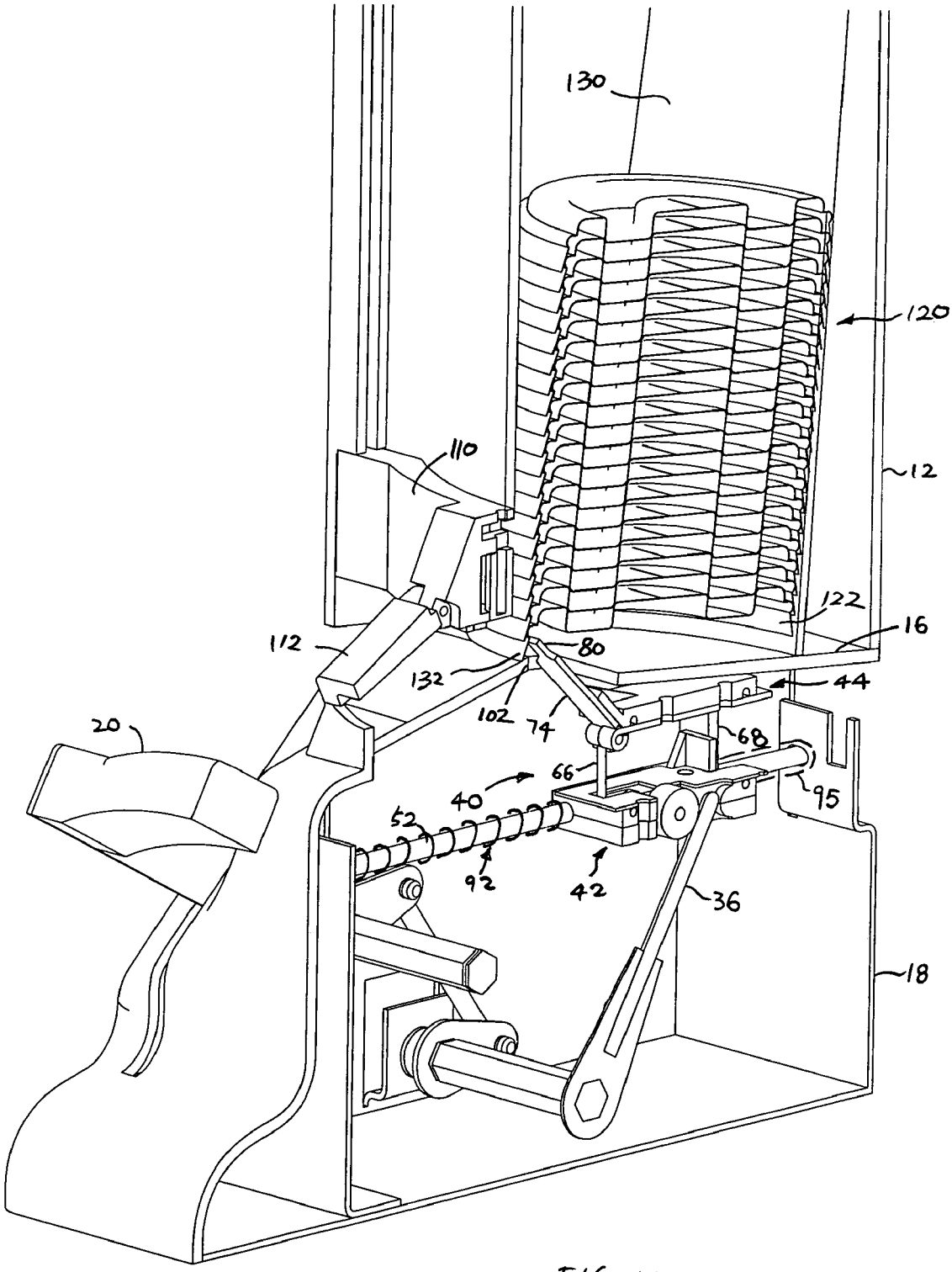
FIG. 12 is a perspective view showing a home position of the parallelogram mechanism in the lid dispenser of FIG. 1.
Figure 13:
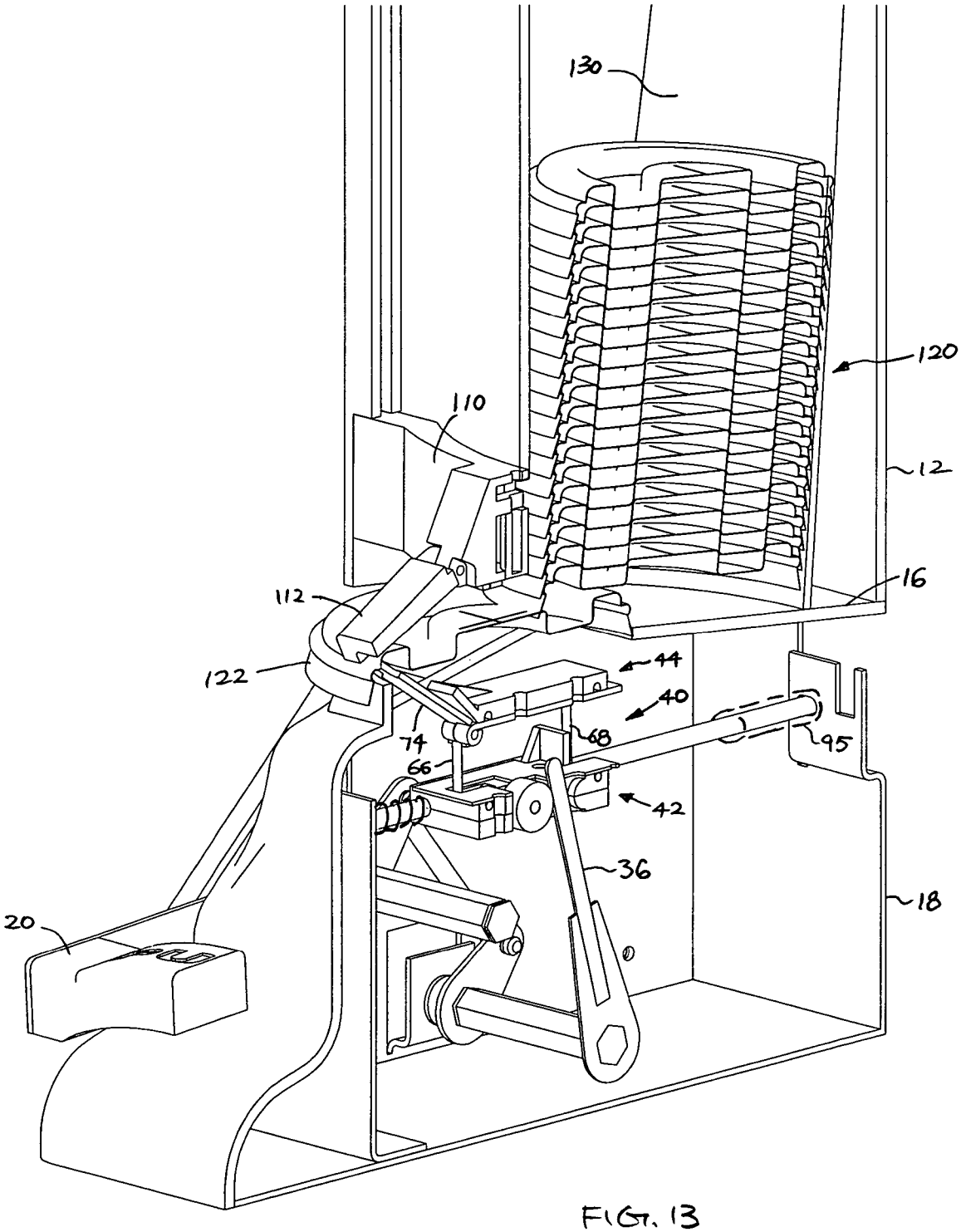
FIG. 13 is a perspective view showing a dispense position of the parallelogram mechanism in the lid dispenser of FIG. 1.

FIG. 12 shows the parallelogram assembly 40 in the rearward, home position, and FIG. 13 shows the parallelogram assembly 40 in the forward, dispense position, to dispense the bottom lid 122 from the stack of lids 120. As the parallelogram assembly 40 is brought forward through a dispense cycle by means of the mechanical linkage, the two fingers 80 on the distal free end of the handle 73 of the spring loaded hinge 74 contact and interact with the lid skirt or lid periphery of the bottommost lid 122 in the stack 120. Initially, forward movement of the parallelogram assembly 40 brings the entire stack of lids 120 forward and in contact with the lid nacelle 110. Once this contact with the nacelle 110 has been established, additional forward movement of the parallelogram assembly 40 causes the upper part 44 of the parallelogram 40 to remain stationary as the lower portion 42 of the parallelogram assembly 40, which is constrained by the carriage rods 52, 53, to continue moving forward. As this forward movement of the lower parallelogram portion 42 continues, the parallelogram wires 66, 68 pivot rearward and cause the upper portion 44 of the parallelogram assembly 40 to deelevate or move downward. Since the two fingers 80 are in contact with the skirt of the bottommost lid 122, this downward movement causes the bottommost lid 122 to deformably move downward and begin to pull out from the bottom of the lid stack 120.

Referring back to the shape of the load platform 16, the downward angle that extends forward from the apex 102 gives the necessary room for the bottommost lid 122 to deform and move forward from the bottom of the lid stack 120. As the parallelogram 40 continues to move forward, the fingers 80 move the lid 122 forward and toward the two symmetric ramps 106 at the dispense point. Ultimately the lid 122 hangs up on the end of the ramps 106 as the hinge fingers 80 come all the way forward. The spring loaded keeper 112 that is connected to the lid nacelle 110 applies a biasing force downward on the lid 122 against the ramps 106, and ensures that the lid 122 comes to its end of travel and does not move any more forward or rearward as the wipe rod 36 moves the parallelogram assembly 40 back to the home position and the return spring 90 returns the parallelogram assembly 40 to its rest configuration, waiting for the next dispense cycle. The spring loaded keeper 112 keeps a dispensed lid from being shot out of the dispenser 10 by impeding the forward momentum of the lid 122 being dispensed after being separated from the stack of lids 120.

Design of the lid housing 12 is such that the basic size of the housing is prescribed so that the largest lid desired can be dispensed. In the current case, this lid is typically referred to "extra-large" or "King" size. Maximum outside diameter of this type of lid is approximately 4.60 inches. One feature of the present invention is to always register the forward tangent point of a lid to be dispensed in the same location with respect to the housing 12 and also with respect to the parallelogram assembly spring loaded hinge fingers 80. In order to accomplish this, spacers referred to as lid inserts or spacer shims 130 are utilized. One lid insert 130 is shown in FIGS. 2, 3, 12, and 13. The lid insert 130 preferably has a shape that generally matches the shape of the circumference of the lids. This is important for several reasons.

The use of lid inserts 130 at the interior of the lid dispenser 10 ensures that a given lid housing 12 is sized to accept the largest size of lid by default, and then if an end user wants to dispense a smaller lid, it is only necessary to insert an appropriately sized lid insert to bring the front tangent edge 132 of the lid stack 120 into proper orientation with respect to the parallelogram assembly 40, as seen in FIGS. 12 and 13. By registering the forward tangent point 132 of a lid in the same place, regardless of lid size allows the parallelogram assembly dispense mechanism 40 to operate according to the same physical principles regardless of lid size dispensed. This methodology ensures a minimized manufacturing cost when designing for lid size since the lid insert 130 can be sized for infinite variations of lid size up to and including the maximum size to be dispensed. This flexibility gives the customers value since if they purchase lid dispensers and then subsequently change lid sizes, the dispenser is still of utility with the possible requirement of purchasing an additional low cost lid insert for the new lids.

Figure 14:
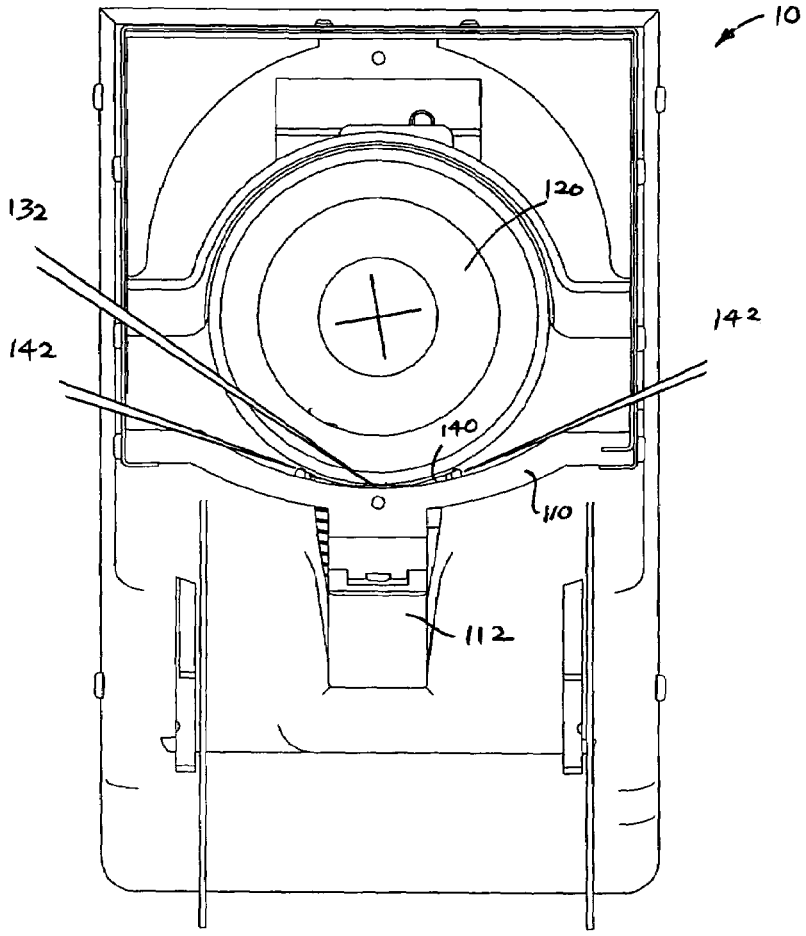
FIG. 14 is a top plan view showing the position of the lid stack in the lid dispenser of FIG. 1.
Figure 16:
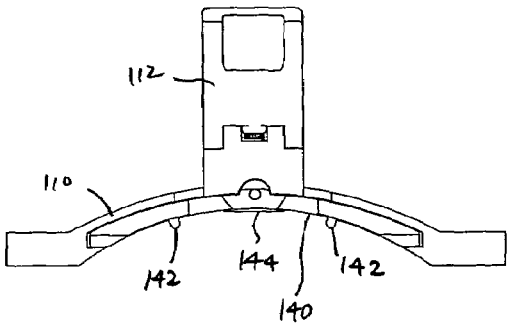
FIG. 16 is a top plan view of the lid nacelle of FIG. 15.
Figure 15:
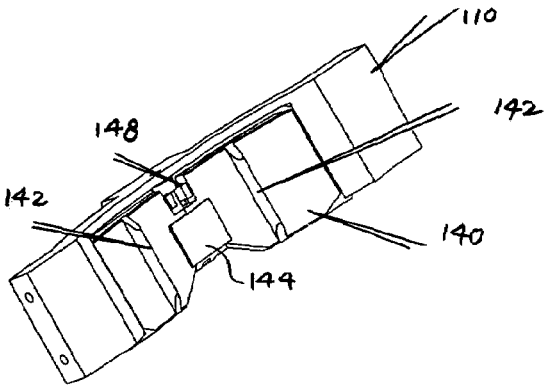
FIG. 15 is a perspective view of a lid nacelle with an adjustable gate in the lid dispenser of FIG. 1.

As seen in FIGS. 14-16, an adjustable vertical gate 140 is provided within the lid nacelle 110 to allow for adjustability in height based on lid size. Typically, a medium lid will have a lid skirt with a smaller vertical height as compared to that of a large lid. The large lid will have a lid skirt with a smaller vertical height as compared to that of an extra large lid. A mechanism, such as a socket head cap screw 148, is provided to adjust the height of the gate 140. The socket head cap screw 148 is retained within the assembly between the nacelle 110 and the adjustable gate 140. Rotation of the screw 148 in one direction causes the gate 140 to lower relative to the nacelle 110, and rotation in the other direction causes the gate 140 to rise. For a larger lid with a taller lid skirt, the height of the adjustable gate 140 is raised as compared to that for a smaller lid with a short lid skirt, so as to provide sufficient room for the bottommost lid 122 to be dispensed from the stack 120.

The adjustable gate 140 preferably also incorporates two vertical ribs 142 on the inner surface which faces the stack of lids 120 contained within the dispenser 10. In between the two ribs 142 is disposed a thin piece of rubber 144 to provide resistance to the lid stack 120 above the bottommost lid 122. The purpose of the two ribs 142 is to provide surfaces against which the parallelogram dispense mechanism 40 can pull the lid stack 120 forward and use the inherent flexibility of the lids themselves to deform toward the piece of rubber 144. While the main lid stack 120 is in contact with the rubber piece 144, the parallelogram mechanism 40 can lower and eject the bottommost lid 122 from the stack 120. When the dispense cycle is over and the parallelogram mechanism 40 returns to the home position, the natural flexibility of the lids, against the vertical ribs 142, will push the lid stack 120 slightly rearward, disengage from the rubber piece and allow the lid stack to drop down and be ready for the next dispense cycle.

Figure 17:
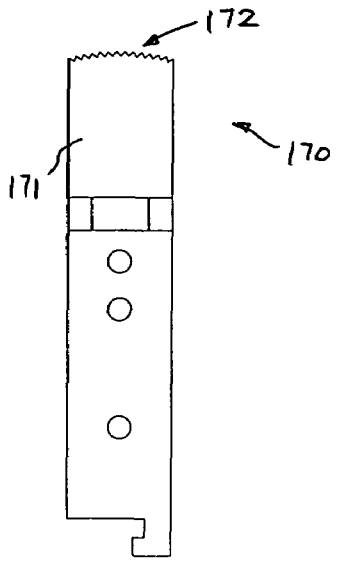
FIG. 17 is a top plan view of a spring loaded hinge of the upper parallelogram structure in the parallelogram mechanism of FIG. 4 according to another embodiment.
Figure 18:
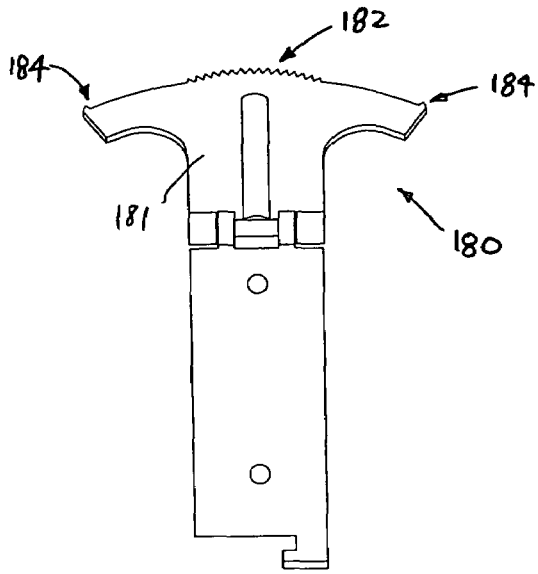
FIG. 18 is a top plan view of a spring loaded hinge of the upper parallelogram structure in the parallelogram mechanism of FIG. 4 according to another embodiment.
Figure 19:
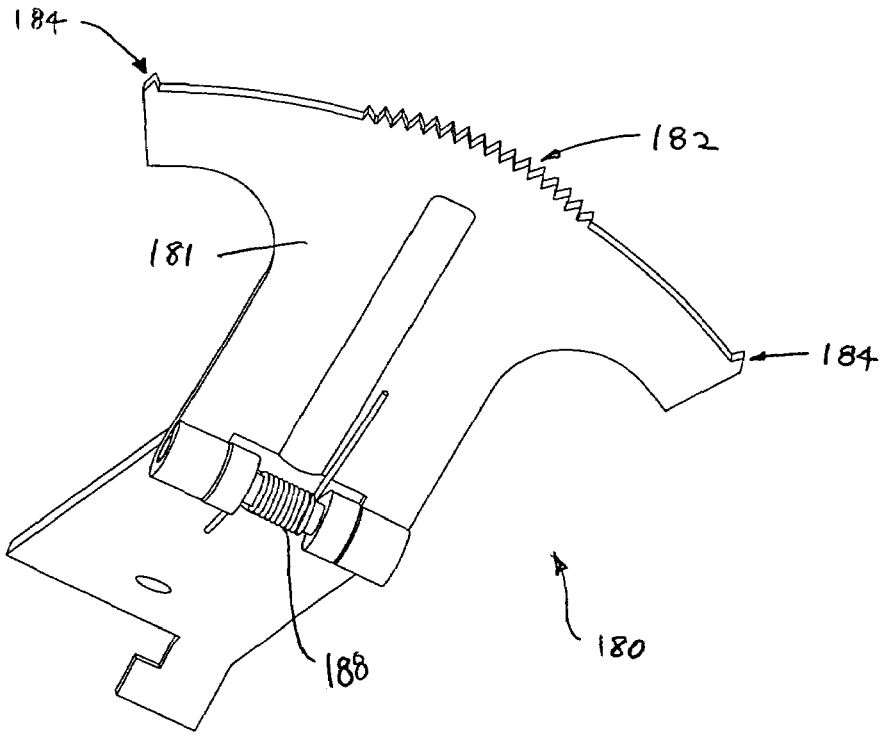
FIG. 19 is a perspective view of the spring loaded hinge of FIG. 18.

The embodiment described above employs a spring loaded hinge 74 having two fingers 80 at the distal free end for moving the bottommost lid 122 forward to dispense the bottommost lid 122 from the lid stack 120. The free end or distal end of the handle 73 of the hinge 74 may have other shapes for moving the bottommost lid 122. FIG. 17 shows a hinge 170 having a plurality of contact protrusions 172 at the distal end of the handle 171, preferably more than two, disposed on a convex curved edge. The hinge 170 is configured to accommodate the large variety of sizes and configurations of lids. It allows the initial point of contact between the distal end of the hinge 170 and the lid 122 to be followed by two or more points of contact at wider radii. This alleviates the tendency of the many variations in lids from bending and distorting upon ejection, as well as double lid ejections. FIG. 18 shows a hinge 180 having a wider or enlarged distal end provided with multiple contact protrusions 182 disposed near the central portion of the distal end of the handle 181 and at least one contact protrusion 184 disposed at each end of the curved distal end. The wider distal end further improves the contact between the distal end contact protrusions and the inner surface of the lid skirt or lid periphery of the bottommost lid 122 during lid dispensing to avoid bending and distorting the lid upon ejection. FIG. 19 another view of the hinge 180 showing the torsion spring 188 for biasing the handle 181. A similar spring can be used for the other hinge embodiments.

It is to be understood that the above description is intended to be illustrative and not restrictive. Many embodiments will be apparent to those of skill in the art upon reviewing the above description. The scope of the invention should, therefore, be determined not with reference to the above description, but instead should be determined with reference to the appended claims along with their full scope of equivalents.

What is claimed is:

1. A dispensing apparatus for dispensing a lid from a stack of lids each having a lid periphery, the apparatus comprising:

a load platform having a main floor on which to place a stack of lids, the main floor sloping downward from an apex in a rearward direction, the load platform having a forward slope inclined downward from the apex in a forward direction;

a parallelogram mechanism having a lower parallelogram portion, an upper parallelogram portion, and a pair of parallelogram wires connected between the lower parallelogram portion and the upper parallelogram portion to form a parallelogram and permit the lower parallelogram portion to move with respect to the upper parallelogram portion to change a shape of the parallelogram formed thereby, the parallelogram mechanism being mounted to move in a linear direction forward to a dispense position and rearward to a home position; and a hinge coupled to the upper parallelogram portion and having a rotatable handle with a distal end oriented upward and forward to contact an inner surface of a lid periphery of a bottommost lid of the stack of lids when the parallelogram mechanism moves forward from the home position toward the dispense position;

wherein after the distal end of the handle of the hinge contacts the inner surface of the lid periphery of the bottommost lid, the upper parallelogram portion stops moving forward and the lower parallelogram portion continues moving forward to de-elevate the upper parallelogram portion and move the distal end of the handle of the hinge downward causing the bottommost lid to deformably move downward to the forward slope of the load platform to separate from the stack of lids for dispensing;

and wherein the lower parallelogram portion of the parallelogram mechanism is slidably coupled with a plurality of carriage rods to move in the linear direction forward to the dispense position and rearward to the home position.

2. The apparatus of claim 1 further comprising a return spring coupled between the upper parallelogram portion and the lower parallelogram portion of the parallelogram mechanism to bias the parallelogram mechanism toward a rest configuration in which the upper parallelogram portion is not de-elevated.

3. The apparatus of claim 1 further comprising a reverse travel stop in the home position to prevent the parallelogram mechanism from moving past the home position rearward.

4. The apparatus of claim 1 wherein the rotatable handle of the hinge is spring loaded in rotation to bias the distal end of the handle of the hinge in an upward direction to move the lid periphery of the bottommost lid forward.

5. A dispensing apparatus for dispensing a lid from a stack of lids each having a lid periphery, the apparatus comprising:

a load platform having a main floor on which to place a stack of lids, the main floor sloping downward from an apex in a rearward direction, the load platform having a forward slope inclined downward from the apex in a forward direction;

a parallelogram mechanism having a lower parallelogram portion, an upper parallelogram portion, and a pair of parallelogram wires connected between the lower parallelogram portion and the upper parallelogram portion to form a parallelogram and permit the lower parallelogram portion to move with respect to the upper parallelogram portion to change a shape of the parallelogram formed thereby, the parallelogram mechanism being mounted to move in a linear direction forward to a dispense position and rearward to a home position; and a hinge coupled to the upper parallelogram portion and having a rotatable handle with a distal end oriented upward and forward to contact an inner surface of a lid periphery of a bottommost lid of the stack of lids when the parallelogram mechanism moves forward from the home position toward the dispense position;

wherein after the distal end of the handle of the hinge contacts the inner surface of the lid periphery of the bottommost lid, the upper parallelogram portion stops moving forward and the lower parallelogram portion continues moving forward to de-elevate the upper parallelogram portion and move the distal end of the handle of the hinge downward causing the bottommost lid to deformably move downward to the forward slope of the load platform to separate from the stack of lids for dispensing;

and wherein the upper parallelogram portion includes a travel stop for the handle of the hinge to stop rotation of the handle of the hinge at a location to limit rearward movement of the distal end of the handle of the hinge.

6. A dispensing apparatus for dispensing a lid from a stack of lids each having a lid periphery, the apparatus comprising:

a load platform having a main floor on which to place a stack of lids, the main floor sloping downward from an apex in a rearward direction, the load platform having a forward slope inclined downward from the apex in a forward direction;

a parallelogram mechanism having a lower parallelogram portion, an upper parallelogram portion, and a pair of parallelogram wires connected between the lower parallelogram portion and the upper parallelogram portion to form a parallelogram and permit the lower parallelogram portion to move with respect to the upper parallelogram portion to change a shape of the parallelogram formed thereby, the parallelogram mechanism being mounted to move in a linear direction forward to a dispense position and rearward to a home position; and a hinge coupled to the upper parallelogram portion and having a rotatable handle with a distal end oriented upward and forward to contact an inner surface of a lid periphery of a bottommost lid of the stack of lids when the parallelogram mechanism moves forward from the home position toward the dispense position;

wherein after the distal end of the handle of the hinge contacts the inner surface of the lid periphery of the bottommost lid, the upper parallelogram portion stops moving forward and the lower parallelogram portion continues moving forward to de-elevate the upper parallelogram portion and move the distal end of the handle of the hinge downward causing the bottommost lid to deformably move downward to the forward slope of the load platform to separate from the stack of lids for dispensing;

and wherein the distal end of the handle of the hinge includes a plurality of contact protrusions;

and wherein the distal end of the handle of the hinge has a convex curved edge and the plurality of contact protrusions are formed along at least a portion of the curved edge.

7. The apparatus of claim 6 wherein the distal end of the handle of the hinge is enlarged to have a wide distal end to provide more contact between the contact protrusions and the inner surface of the lid periphery of the bottommost lid to move the bottommost lid forward to dispense the bottommost lid.

8. A dispensing apparatus for dispensing a lid from a stack of lids each having a lid periphery, the apparatus comprising:

a load platform having a main floor on which to place a stack of lids, the main floor sloping downward from an apex in a rearward direction, the load platform having a forward slope inclined downward from the apex in a forward direction;

a parallelogram mechanism having a lower parallelogram portion, an upper parallelogram portion, and a pair of parallelogram wires connected between the lower parallelogram portion and the upper parallelogram portion to form a parallelogram and permit the lower parallelogram portion to move with respect to the upper parallelogram portion to change a shape of the parallelogram formed thereby, the parallelogram mechanism being mounted to move in a linear direction forward to a dispense position and rearward to a home position;

a hinge coupled to the upper parallelogram portion and having a rotatable handle with a distal end oriented upward and forward to contact an inner surface of a lid periphery of a bottommost lid of the stack of lids when the parallelogram mechanism moves forward from the home position toward the dispense position; and a lid blocker disposed forward of the load platform to block forward movement of the stack of lids when the parallelogram mechanism drives the hinge to move the bottommost lid forward for dispensing;

wherein after the distal end of the handle of the hinge contacts the inner surface of the lid periphery of the bottommost lid, the upper parallelogram portion stops moving forward and the lower parallelogram portion continues moving forward to de-elevate the upper parallelogram portion and move the distal end of the handle of the hinge downward causing the bottommost lid to deformably move downward to the forward slope of the load platform to separate from the stack of lids for dispensing;

and wherein the lid blocker has an adjustable gate disposed rearward to face the stack of lids, the adjustable gate being adjustable vertical in height to accommodate different heights of lids to be dispensed.

9. The apparatus of claim 8 wherein the lid blocker includes a screw coupled to the adjustable gate to adjust the vertical position of the adjustable gate.

10. The apparatus of claim 8 wherein the adjustable gate includes a pair of vertical ribs to contact the stack of lids to block forward movement of the stack of lids when the parallelogram mechanism drives the hinge to move the bottommost lid forward for dispensing, and to provide a space between the vertical ribs for the lids to deform.

11. The apparatus of claim 10 wherein the adjustable gate includes a rubber surface disposed between the pair of vertical ribs for contacting the lid peripheries of the lids moving forward.

12. A dispensing apparatus for dispensing a lid from a stack of lids each having a lid periphery, the apparatus comprising:

a load platform having a main floor on which to place a stack of lids, the main floor sloping downward from an apex in a rearward direction, the load platform having a forward slope inclined downward from the apex in a forward direction;

a parallelogram mechanism having a lower parallelogram portion, an upper parallelogram portion, and a pair of parallelogram wires connected between the lower parallelogram portion and the upper parallelogram portion to form a parallelogram and permit the lower parallelogram portion to move with respect to the upper parallelogram portion to change a shape of the parallelogram formed thereby, the parallelogram mechanism being mounted to move in a linear direction forward to a dispense position and rearward to a home position;

a hinge coupled to the upper parallelogram portion and having a rotatable handle with a distal end oriented upward and forward to contact an inner surface of a lid periphery of a bottommost lid of the stack of lids when the parallelogram mechanism moves forward from the home position toward the dispense position; and a keeper disposed forward of and rotatably coupled to the lid blocker, the keeper being biased in the rearward direction to impede forward momentum of the lid being dispensed after being separated from the stack of lids;

wherein after the distal end of the handle of the hinge contacts the inner surface of the lid periphery of the bottommost lid, the upper parallelogram portion stops moving forward and the lower parallelogram portion continues moving forward to de-elevate the upper parallelogram portion and move the distal end of the handle of the hinge downward causing the bottommost lid to deformably move downward to the forward slope of the load platform to separate from the stack of lids for dispensing.

13. A dispensing apparatus for dispensing a lid from a stack of lids each having a lid periphery, the apparatus comprising:

a load platform having a main floor on which to place a stack of lids, the main floor sloping downward from an apex in a rearward direction, the load platform having a forward slope inclined downward from the apex in a forward direction;

a parallelogram mechanism having a lower parallelogram portion, an upper parallelogram portion, and a pair of parallelogram wires connected between the lower parallelogram portion and the upper parallelogram portion to form a parallelogram and permit the lower parallelogram portion to move with respect to the upper parallelogram portion to change a shape of the parallelogram formed thereby, the parallelogram mechanism being mounted to move in a linear direction forward to a dispense position and rearward to a home position;

a hinge coupled to the upper parallelogram portion and having a rotatable handle with a distal end oriented upward and forward to contact an inner surface of a lid periphery of a bottommost lid of the stack of lids when the parallelogram mechanism moves forward from the home position toward the dispense position; and a lid insert selected to be disposed on the load platform to register a forward tangent point of the bottommost lid to be dispensed in a same location regardless of a size of the bottommost lid;

wherein after the distal end of the handle of the hinge contacts the inner surface of the lid periphery of the bottommost lid, the upper parallelogram portion stops moving forward and the lower parallelogram portion continues moving forward to de-elevate the upper parallelogram portion and move the distal end of the handle of the hinge downward causing the bottommost lid to deformably move downward to the forward slope of the load platform to separate from the stack of lids for dispensing.

14. A dispensing apparatus for dispensing a lid from a stack of lids each having a lid periphery, the apparatus comprising:

a load platform having a main floor on which to place a stack of lids, the main floor sloping downward from an apex in a rearward direction, the load platform having a forward slope inclined downward from the apex in a forward direction;

means for moving a handle in a linear direction forward to a dispense position and rearward to a home position, for moving a distal end of the handle forward to contact an inner surface of a lid periphery of a bottommost lid of the stack of lids toward the dispense position, and for de-elevating the handle in the dispense position to cause the bottommost lid to deformably move downward to the forward slope of the load platform to separate from the stack of lids for dispensing;

wherein the distal end of the handle includes a plurality of contact protrusions;

and wherein the distal end of the handle has a convex curved edge and the plurality of contact protrusions are formed along at least a portion of the curved edge.

15. A dispensing apparatus for dispensing a lid from a stack of lids each having a lid periphery, the apparatus comprising:

a load platform having a main floor on which to place a stack of lids, the main floor sloping downward from an apex in a rearward direction, the load platform having a forward slope inclined downward from the apex in a forward direction;

means for moving a handle in a linear direction forward to a dispense position and rearward to a home position, for moving a distal end of the handle forward to contact an inner surface of a lid periphery of a bottommost lid of the stack of lids toward the dispense position, and for de-elevating the handle in the dispense position to cause the bottommost lid to deformably move downward to the forward slope of the load platform to separate from the stack of lids for dispensing; and a lid insert selected to be disposed on the load platform to register a forward tangent point of the bottommost lid to be dispensed in a same location regardless of a size of the bottommost lid.

* * * * *